US005598258A

United States Patent [19]

Sato et al.

[11] Patent Number: 5,598,258

[45] Date of Patent: Jan. 28, 1997

[54] IMAGE FORMING APPARATUS WITH INTERCONNECTED SORTERS AND CONTROL DEVICE THEREFOR

[75] Inventors: Mitsuo Sato, Shibata-machi; Tomoya Otomo, Sendai, both of Japan

[73] Assignees: Tohoku Ricoh Co., Ltd., Miyagi-ken; Canon Aptex Inc., Mitsukaido, both of Japan

[21] Appl. No.: 389,953

[22] Filed: Feb. 17, 1995

[30] Foreign Application Priority Data

May 16, 1994 [JP] Japan ..... 6-101417

[51] Int. Cl.[6] ..... G03G 21/00

[52] U.S. Cl. ..... 399/85; 271/279; 399/16; 399/410

[58] Field of Search ..... 355/308, 309, 355/313, 314, 321, 322, 323, 324; 271/279, 287, 288, 296, 298

[56] References Cited

U.S. PATENT DOCUMENTS

| | | | |
|---|---|---|---|
| 4,330,200 | 5/1982 | Kikuchi et al. | 271/288 X |
| 4,709,915 | 12/1987 | Ishikawa et al. | 271/288 |
| 4,851,876 | 7/1989 | Yamamoto et al. | 355/323 |
| 5,011,130 | 4/1991 | Naito et al. | 271/288 |
| 5,177,546 | 1/1993 | Tsubo | 355/314 |
| 5,204,728 | 4/1993 | Braswell | 355/323 |
| 5,236,189 | 8/1993 | Ikoma | 355/323 X |

FOREIGN PATENT DOCUMENTS

| | | |
|---|---|---|
| 60-248566 | 12/1985 | Japan . |
| 2-56367 | 2/1990 | Japan . |
| 3-6104 | 1/1991 | Japan . |
| 5-229243 | 9/1993 | Japan . |

*Primary Examiner*—Sandra L. Brase

*Attorney, Agent, or Firm*—Oblon, Spivak, McClelland, Maier & Neustadt, P.C.

[57] ABSTRACT

An image forming apparatus operable with a plurality of on-line sorters each having a plurality of bins, and a control device therefor are disclosed. A first sorter and a second sorter, for example, are linked to a stencil printer in an online configuration. A sorter to be used can be freely selected or can be automatically selected by the control device. A sorter link mode key is pressed in a particular manner to select one of a first sorfer priority mode, second sorter priority mode, first sorter only mode, and second sorter only mode. One of the first and second sorters is selected on the basis of the mode selected on the sorter link mode key.

5 Claims, 5 Drawing Sheets

IMAGE FORMING APPARATUS WITH INTERCONNECTED SORTERS AND CONTROL DEVICE THEREFOR

BACKGROUND OF THE INVENTION

1. Field of the Invention

The present invention relates to an image forming apparatus operable with a plurality of interconnected on-line sorters each having a plurality of bins, and a control device therefor.

2. Discussion of the Background

Today, a sorter is extensively used with an image forming apparatus, e.g., a stencil printer or an electrophotographic copier, printer or facsimile apparatus. Papers sequentially coming out of the image forming apparatus and each carrying an image thereon are automatically distributed, or sorted, to a plurality of bins arranged in the sorter. This kind of sorter is generally referred to as an on-line sorter. The on-line sorter usually has about twenty bins. A plurality of sorters may be interconnected in an on-line configuration in order to replenish the shortage in the number of bins. Japanese Patent Laid-Open Publication No. 60-248566, for example, discloses in FIG. 3 thereof a stencil printer operable with such on-line sorters. The stencil printer has sorters serially connected to the paper outlet thereof. Each sorter has a bin unit implemented as a stack of bins and movable up and down.

However, the conventional printer with sorters has the following problems to be solved. Assume that the number of printings derived from a single document is small enough to be accommodated in one sorter. Then, all the printings are distributed to the first sorter with the result that the second sorter and successive sorters simply remain idle. Hence, only the first sorter is used every time the printer is operated. Regarding easy take-out of printings, when two on-line sorters are connected to the printer, the first sorter is, of course, inferior to the second sorter. In addition, when all the desired prints are received in the first sorter, it is more difficult to take out the printings from the lower bins than to take them out from the upper bins since the housing of the second sorter gets in the way. While the take-out of printings from the bins of the first sorter will be facilitated if the distance between the first and second sorters is increased, the distance between the sorters should be as short as possible in order to save space.

Another problem with the conventional stencil printer with on-line sorters is that since a printing coming out of the printer carries an excessive amount of ink which is still wet, it smears another printing or is smeared by another printing when distributed to a bin. Specifically, when a printing from the printer is driven out to a tray or a bin over a printing existing there, wet ink on the underlying printing deposits on the underside or rear of the overlying printing and smears it. Further, the overlying printing is moved deeper into the tray or the bin while rubbing the underlying printing with the leading edge thereof. As a result, the rear, particularly leading edge portion, of the overlying printing is noticeably smeared by the underlying printing.

Increasing the interval between the printing and the delivery to a bin as far as possibleis an effective measure against the smears on the rear and leading edges of printings. In this respect, the scond sorter and successive sorters are more desirable than the first sorter since the former has a longer transport distance to the printer than the latter. The longer transport distance translates into a longer transporting time and, therefore, allows the ink to dry. However, it has been customary to automatically distribute printings to the first sorter and then distribute, only when the first sorter becomes full, the other printings to the second sorter and successive sorters.

It follows that when one of the second and successive sorters in used piror to the first sorter, both the easy take-out of printings and the protection of printings from smears of the kind described are achievable. However, this kind of approach brings about another problem that the total printing time increases for the following reasons. First, the bin unit of each sorter usually reaches a home position when it is lowered. A printing operation begins when the bin unit is held in such a home position. As for the first sorter, it should only sequentially raise the bin unit thereof in synchronism with the consecutive printings from the printer. However, when printings should be distributed to the second sorter first, it is necessary to elevate the bin unit of the first conveying unit mounted on the bottom of the bin unit for operation. Second, since the transport distance to the second sorter is longer than the distance to the first sorter, a longer period of time is necessary for a printing to be received in the bin of the second sorter than in the bin of the first sorter.

Another conventional stencil printer operable with sorters has a group mode in addition to a sort mode. In the sort mode, printings derived from a plurality of pages of documents are distributed to each bin in order of page. In the group mode, printings derived from a single document are distributed to bins while being divided into groups each having a desired number of printings. Generally, the group mode is practicable with a minimum number of bins, e.g., twenty bins or less. Hence, while the first sorter is used, the second sorter is not used at all. Moreover, even after printings have been fully sorted by the first sorter, the printer cannot perform the next printing operation unless all the printings are taken out from the bins of the first sorter. This is undesirable in respect of time saving, particularly when urgent printings are desired.

The printer disclosed in, for example, previously mentioned Laid-Open Publication, FIG. 3, has only one non-sort tray. Assume that a number of printings should be produced in a non-sort mode, but the number exceeds the maximum number of printings which can be stacked on the non-sort tray. Then, the operator must take out printings several times in stacks each corresponding to the capacity of the non-sort tray while a printing operation is under way. This is not only troublesome but also forces the operator to stand by the printer until the printing operation ends.

SUMMARY OF THE INVENTION

It is, therefore, an object of the present invention to provide an image forming apparatus which allows a sorter to be used freely selected or selects it automatically so as to meet the user's varying situation and needs, and a control device therefor.

In accordance with the present invention, a control device for controlling an image forming apparatus having a plurality of interconnected sorters each having a plurality of bins for sorting papers undergone image formation has at least one of a priority mode setting device for setting a priority mode for causing one of the first sorter to the last sorter to operate prior to the other sorter, and an exclusive mode setting device for causing only one of the first sorter to the last sorter to operate, and a controller for selecting the sorter to be used in response to the output signal of the priority mode setting device or the output signal of the exclusive mode setting device.

Also, in accordance with the present invention, a control device for controlling an image forming apparatus having a plurality of interconnected sorters each having a plurality of bins for sorting papers undergone image formation and a non-sort tray has a non-sort mode setting device for setting up a non-sort mode for stacking the papers derived from a single document on the non-sort tray, a non-sort tray paper sensor for determining whether or not the papers are present on the non-sort tray, and a controller for executing, when the non-sort mode is selected and the number of papers to be received in a single non-sort tray is greater than the maximum number available with the non-sort tray, control such that the papers matching the maximum number are stacked on the non-sort tray where the papers are absent while the other papers exceeding the maximum number are stacked on another non-sort tray where the papers are absent.

BRIEF DESDR1PTION OF THE DRAWINGS

The above and other objects, features and advantages of the present invention will become apparent from the following detailed description taken with the accompnaying drawings in which.

DESCRIPTION OF THE PREFERRED EMBODIMENT

Figure 1:
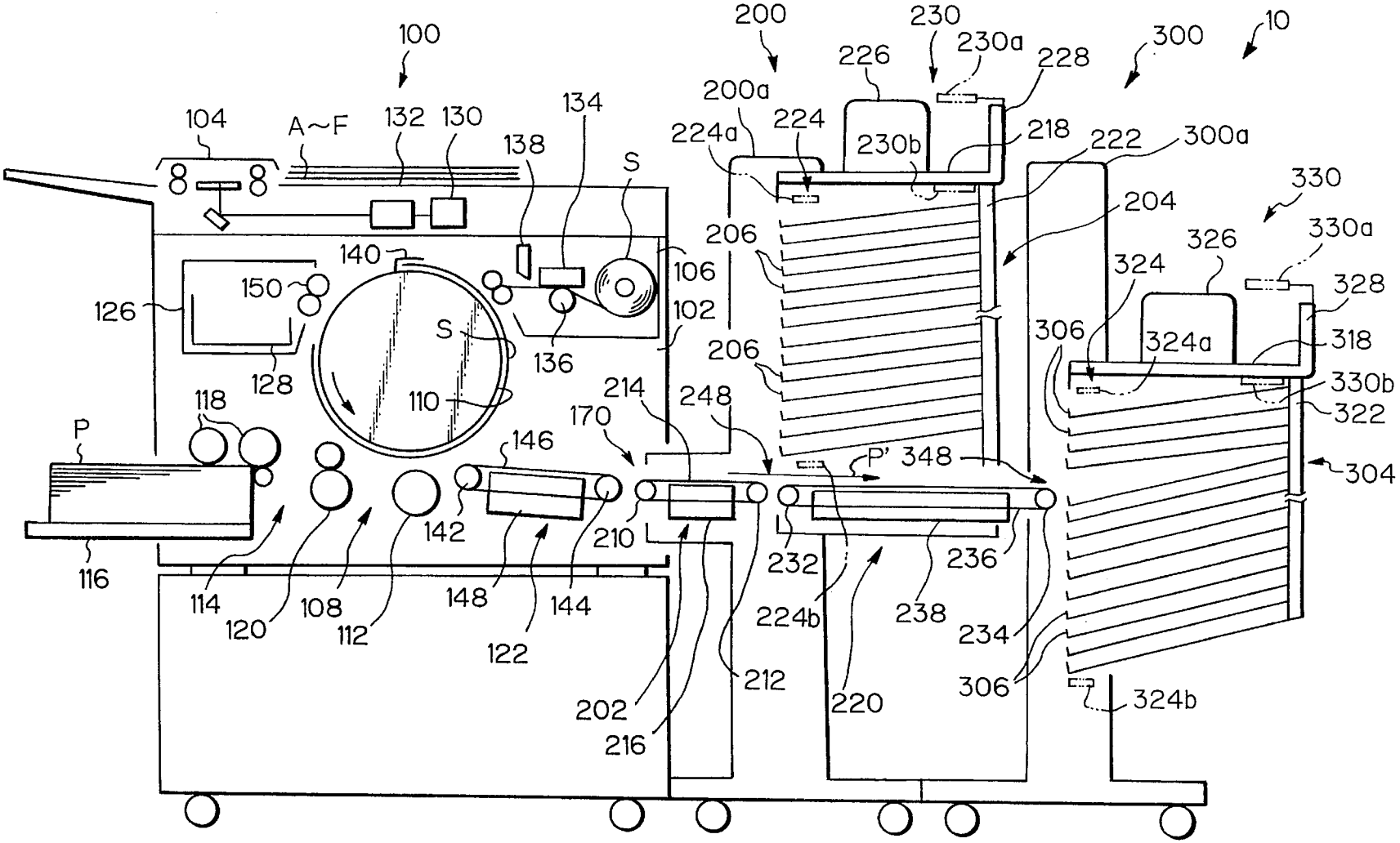
FIG. 1 is a section showing the entire system of an image forming apparatus having on-line sorters and to which the present invention is applied.

Referring to FIG. 1 of the drawings, an image forming apparatus to which the present invention is applied is shown and implemented as a stencil printer by way of example. While the stencil printer is operable with a plurality of sorters, the following description will concentrate on two sorters connected in an on-line configuration.

As shown, a stencil printer 100, a first sorter 200 and a second sorter 300 are operatively connected to each other in a system 10. The sorter 200 is connected to the printer 100. The sorters 200 and 300 are electrically connected together by a communication line, not shown, and each is implemented as a bin unit elevation type sorter. The construction and operation of the system 10 will be outlined first.

The printer 100 has an image scanner 104 mounted on the top of a housing 102 in order to sequentially read the images of a plurality of documents A–F. An ADF (Automatic Document Feeder), not shown, feeds the documents A–F to the image scanner 104 one by one while collecting them. A master making and feeding device 106 is disposed below the image scanner 104 and adjacent to one side of the housing 102. The device 106 pays out a stencil S from a stencil roll in order to make a master. A print drum 110 is positioned substantially at the center of the housing 102 to allow the stencil S to be wrapped therearound. A press roller 112 is selectively pressed against the print drum 110 via a paper, not shown. The print drum 110 and press roller 112 constitute a print drum and pressing device 108. A paper feeding device 114 is located below and at the left-hand side of the drum and pressing device 108. The device 114 has a tray 116 loaded with a stack of papers P and feeds them to between the drum 110 and the press roller 112 one by one with pick-up rollers 118 and feed rollers 120. A paper discharging device 122 faces the paper feeding device 114 and discharges the paper, or printing P', coming out of the drum and printing device 108 to an intermediate conveying unit 202 included in the first sorter 200. A master collecting device 126 is interposed between the image scanner 104 and the paper feeding device 114. The device 126 has a box 128 for collecting a master used and removed from the print drum 110, as will be described later specifically.

The image scanner 104 may be provided with a construction taught in, for example, Japanese Patent Laid-Open Publication No. 5-229243. The image scanner 104 optically reads the documents A–F sequentially fed thereto with a CCD ( Charge Coupled Device) image sensor 130, thereby transforming optical image data to electric signals. The ADF and a document table 132 loaded with the documents A–F are positioned in the vicinity of the image scanner 104. A document sensor, not shown, is located in a predetermined position on the table 132 and may be implemented as a refleciton type photosensor. The document sensor is electrically connected to a main controller which will be described later.

In the master making and feeding device 106, the stencil roll is mounted on a support member, not shown. A thermal head 134 selectively perforates the stencil S paid out from the roll by heat in accordance with the image data. A platen roller 136 faces the head 134 and drives the stencil S to the downstream side with respect to the intended direction of conveyance while pressing it against the head 134. A cutter 138 cuts the stencil S at a predtermined length. The print drum and pressing device 108 has, in addition to the print drum 110, an openable clamper 140 and an ink supply device, not shown, disposed in the print drum 110. The print drum 110 has a porous hollow cylindrical configuration. A DC motor or similar drive source, not shown, causes the print drum 110 to rotate about its own axis. The openable clamper 140 is mounted on part of the outer periphery of the print drum 110 and clamps the leading edge of the master S. The ink supply device supplies ink to the inner periphery of the print drum 110. The press roller 112 is movable into and out of contact with the print drum 110 and presses the paper P fed from the paper feeding device 114 against the drum 110.

In the paper feeding device 114, the paper tray 116 is loaded with the stack of papers P and is movable up and down. The pick-up rollers 118 rest on the uppermost paper P and feed it while separating it from the other papers P. The feed rollers 120 are located downstream of the pick-up rollers 118 with respect to the intended direction of paper feed and drive the paper P to between the print drum 110 and the press roller 112 at a predetermined timing. The paper discharging device 122 has a conveyor belt 146 adjoining the print drum 110, and a fan 148 located beneath the belt 146. The conveyor belt 146 is passed over rollers 142 and 144. When the paper or printing P' is separated from the print drum 100 by a separator, not shown, the conveyor belt 146 conveys it to the intermediate conveying unit 202 of the first sorter 200. The fan 148 sucks the printing P' being conveyed by the belt 146. The belt 146 is formed with a number of apertures, not shown, and driven by a belt motor, not shown, which is drivably connected to the roller 142. The fan 148 is driven by a fan motor, not shown. The master collecting device 126 has a pair of rollers 150 pressed against each other, in addition to the previously mentioned box 128. The rollers 150 separate the stencil or master S from the print drum 110 in synchronism with the rotation of the drum 110 and collects it in the box 128.

Figure 3:
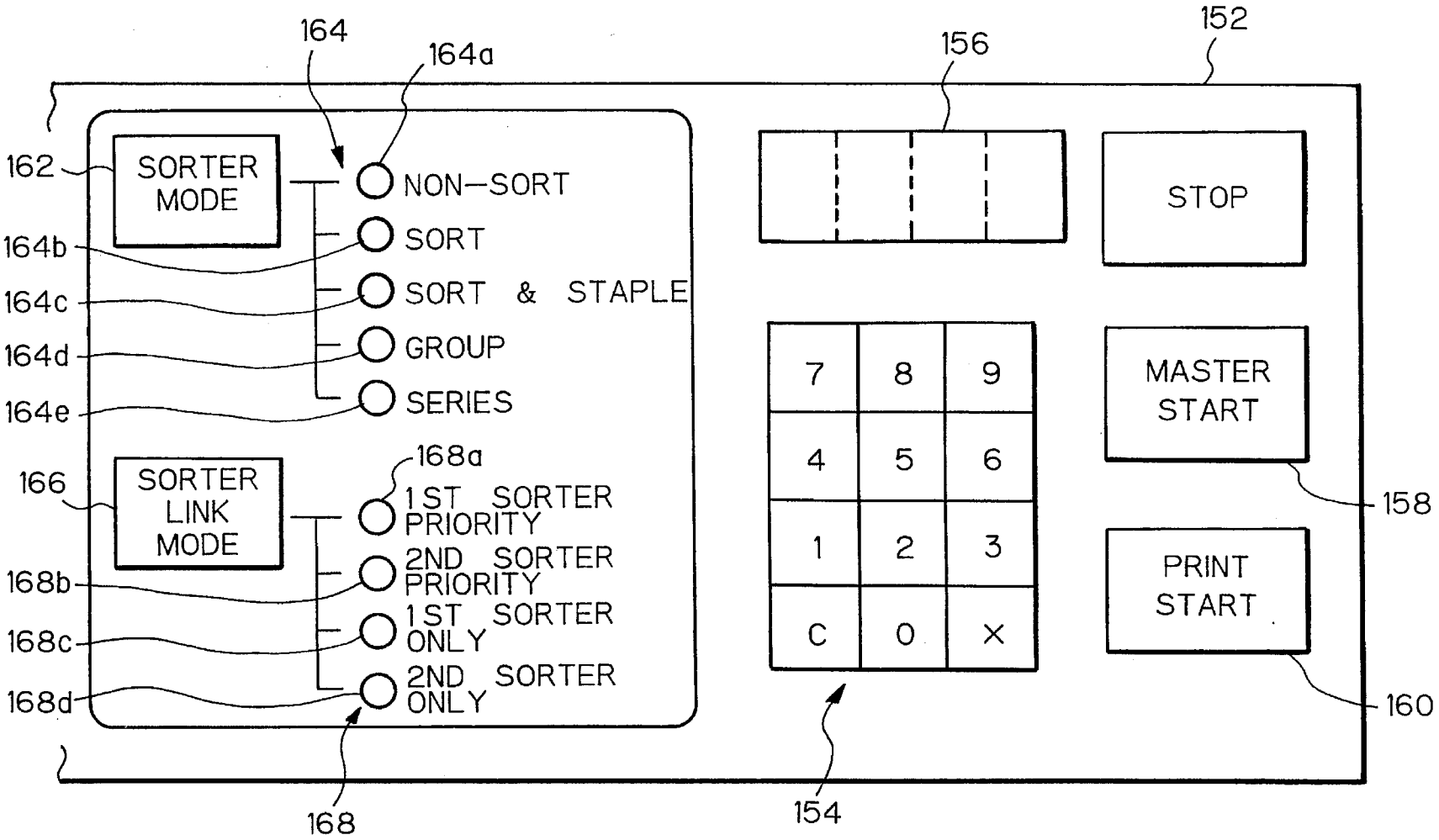
FIG. 3 is a plan view showing a specific configuration of an operation panel also included in the system of FIG. 1.

FIG. 3 shows an operation panel 152 mounted on the top of the image scanner 104 and accessible for operating the printer 100 and sorters 200 and 300. Numeral keys 154 are arranged on the right-hand side of the operation panel 152, as viewed in FIG. 3, and operated to enter the number of desired printings and the number of desired groups. A display 156 is implemented by seven-segment LEDs (Light Emitting Diodes) and displays the numbers entered on the numeral keys 154. A master start key 158 is used to start a master making operation. A print start key 160 is operated to start a sequence of steps up to a printing step. Further, a stop key for interrupting the procedure up to the printing step, print speed change key, manual staple key and other various keys are arranged on the operation panel 152, although not shown in FIG. 3.

Located on the left-hand side of the operation panel 152 are a sorter mode key 162 for entering one of five different modes which will be described later, and five LEDs 164 respectively assigned to the five different modes. Specifically, five LEDs 164*a*–164*e* are arranged in a vertical array, as viewed in the figure. When the sorter mode key 162 is pressed once, the LED 164*a* turns on to show an operator that a non-sort mode has been set up. In the non-sort mode, a plurality of printings derived from a single document are delivered to a non-sort tray which will be described later. When the key 162 is pressed twice, the LED 164*b* turns on to indicate a sort mode. In the sort mode, a plurality of printings respectively corresponding to the consecutive pages of documents are distributed to each bin in order of page. When the key 162 is pressed three times, the LED 164*c* turns on to indicate a sort and staple mode. In the sort and staple mode, each stack of printings prepared in the sort mode is automatically stapled. When the key 162 is pressed four times, the LED 164*d* turns on to indicate a group mode. In the group mode, a plurality of printings associated with a single document are distributed to bins in a desired number of groups. When the key 162 is pressed five times, the LED 164e turns on to indicate a series mode in which a plurality of printings derived from a single document are serially distributed to bins. The operator, therefore, can see the mode selected by looking at the LEDs 164*a*–164*e*. In this sense, the sorter mode key 162 plays the role of non-sort mode inputting means, sort mode inputting means, sort and staple mode inputting means, group mode inputting means, and series mode inputting means.

A sorter link mode key 166 is positioned below the sorter mode key 162 and LEDs 164, as viewed in FIG. 3, and is operated to select one of priority modes and exclusive modes which will be described later. Also positioned below the sorter mode key 162 and LEDs 164 are LEDs 168 each being assinged to one of the priority modes and exclusive modes. Specifically, four LEDs 168*a*–168*d* are arranged in a vertical array, as viewed in FIG. 3. When the sorter link mode key 166 is pressed once, the LED 168a turns on to show that a first sorter priority mode has been set up. In the first sorter priority mode, the first sorter 200 is operated prior to the second sorter 300. When the key 166 is pressed twice, the LED 168*b* turns on to indicate a second sorter priority mode. In this mode, the second sorter 300 is operated prior to the first sorter 200. When the key 166 is pressed three times, the LED 168*c* turns on to indicate a first sorter only mode in which only the first sorter 200 is operable; this mode is one of the exclusive modes mentioned above. When the key 166 is pressed four times, the LED 168*d* turns on to indicate a second sorter only mode in which only the second sorter 300 is operable. The LEDs 168*a*–168*d* allow the operator to see the mode selected by eye. The key 166, therefore, constitutes first sorter priority mode inputting means, second sorter priority mode inputting means, first sorter only mode inputting means, and second sorter only mode inputting means.

An LCD (Liquid Crystal Display), not shown, is mounted on the left-hand side of the operation panel 152 in order to display an alarm message on the basis of information entered on the various keys stated above.

When the operator turns on a power switch, not shown, to use the printer 100, the printer 100 is initialized, i.e., restored to standard modes. The non-sort mode and the first sorter priority mode are the standard sorter mode and the standard sorter link mode, respectively. When the sorter mode key 162 and sorter link mode key 166 are not pressed, such standard modes are automatically set up. Of course, the standard modes may be changed by a serviceman.

The sorters 200 and 300 will be described hereinafter. The intermediate conveying unit 202 is located at one side of the sorter 200. One end of the conveying unit 202 is connected to a paper outlet 170 formed through the printer 100, i.e., the sorter 200 is connected to the printer 100 by the conveying unit 202. When the paper or printing P' is driven out of the printer 100 via the outlet 170 by the paper discharging device 122, the conveying unit 202 receives it and usually delivers it to one of a plurality of bins 206 constituting the sorter 200. The bins 206 are stacked on the bin unit 204 and receive the printings P' from the conveying unit 202 in accordance with the sorter mode selected. A bin unit elevation device 208 causes the bin unit 204 to move up and down.

The intermediate conveying unit 202 is provided with substantially the same construction as the paper discharging device 122. Specifically, the conveying unit 202 has a flat conveyor belt made up of a plurality of belts 214 and passed over rollers 210 and 212 and forming a flat belt in combination. A fan unit 216 is positioned below the conveyor belt 214 in such a manner as to suck the printing P' being conveyed by the belt 214. The flat conveyor belt is formed with a number of apertures for sucking the rear of the printing P'. A belt motor, not shown, is connected to the roller 210 to drive the flat conveyor belt. A fan motor, not shown, drives the fan unit 216.

In the bin unit 204, twenty bins 206 identical in configuration are stacked at predetermined intervals. A non-sort tray 218 is located on the top of the stack of bins 206. A joint conveying unit 220 is mounted on the bottom of the bin unit 204 and is movable up and down integrally with the bins 206. A pair of guide rails, not shown, guide one end, or paper inlet end, of the bins 206 in the up-and-down direction. A casing 222 rotatably supports the other end of the bins 206. A bin unit elevation device 208, FIG. 5, causes the casing 222 to move up and down together with the bins 206.

Figure 2:
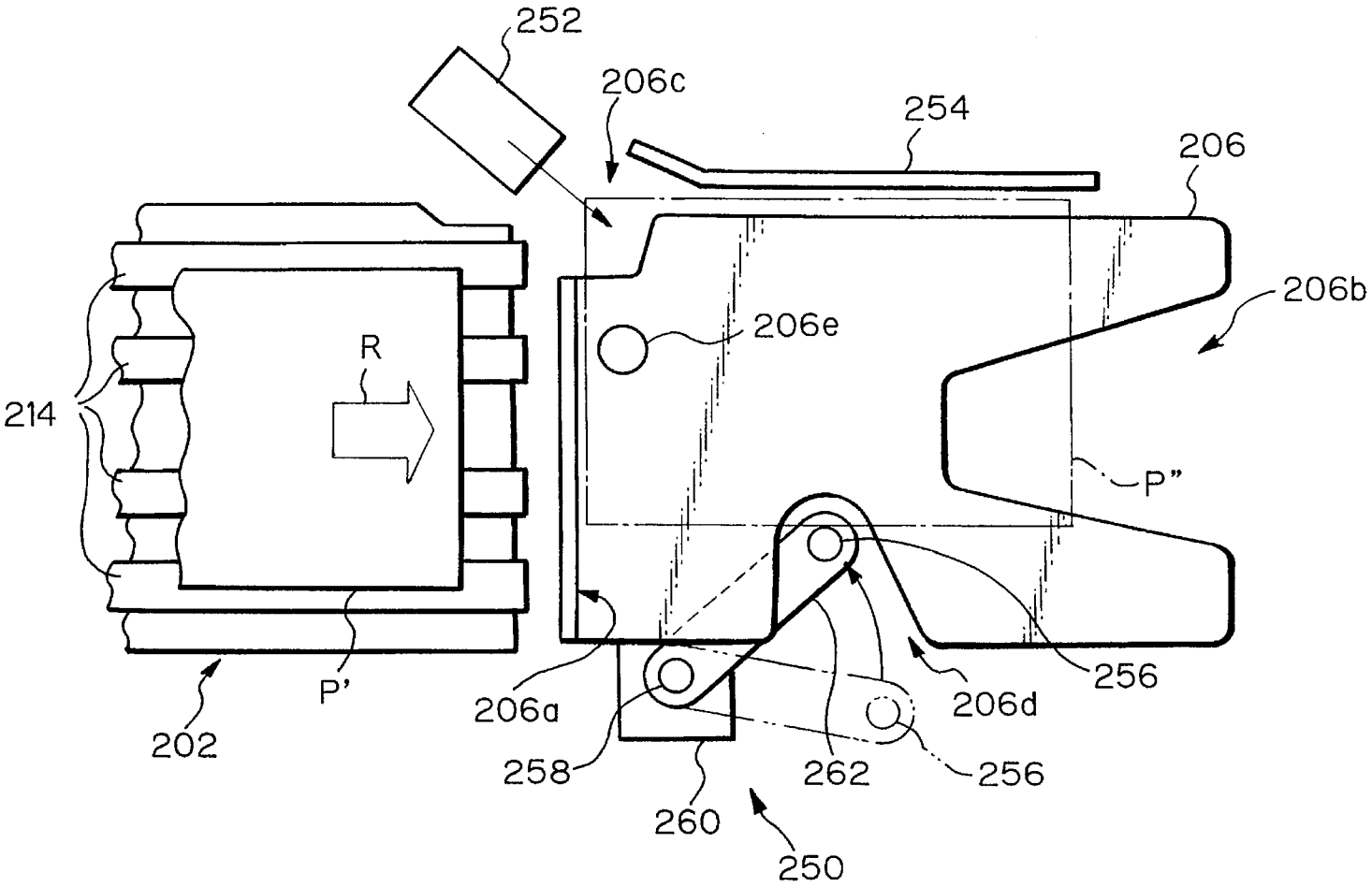
FIG. 2 is a plan view of a bin and an intermediate conveying unit included in the system shown in FIG. 1.
Figure 4:
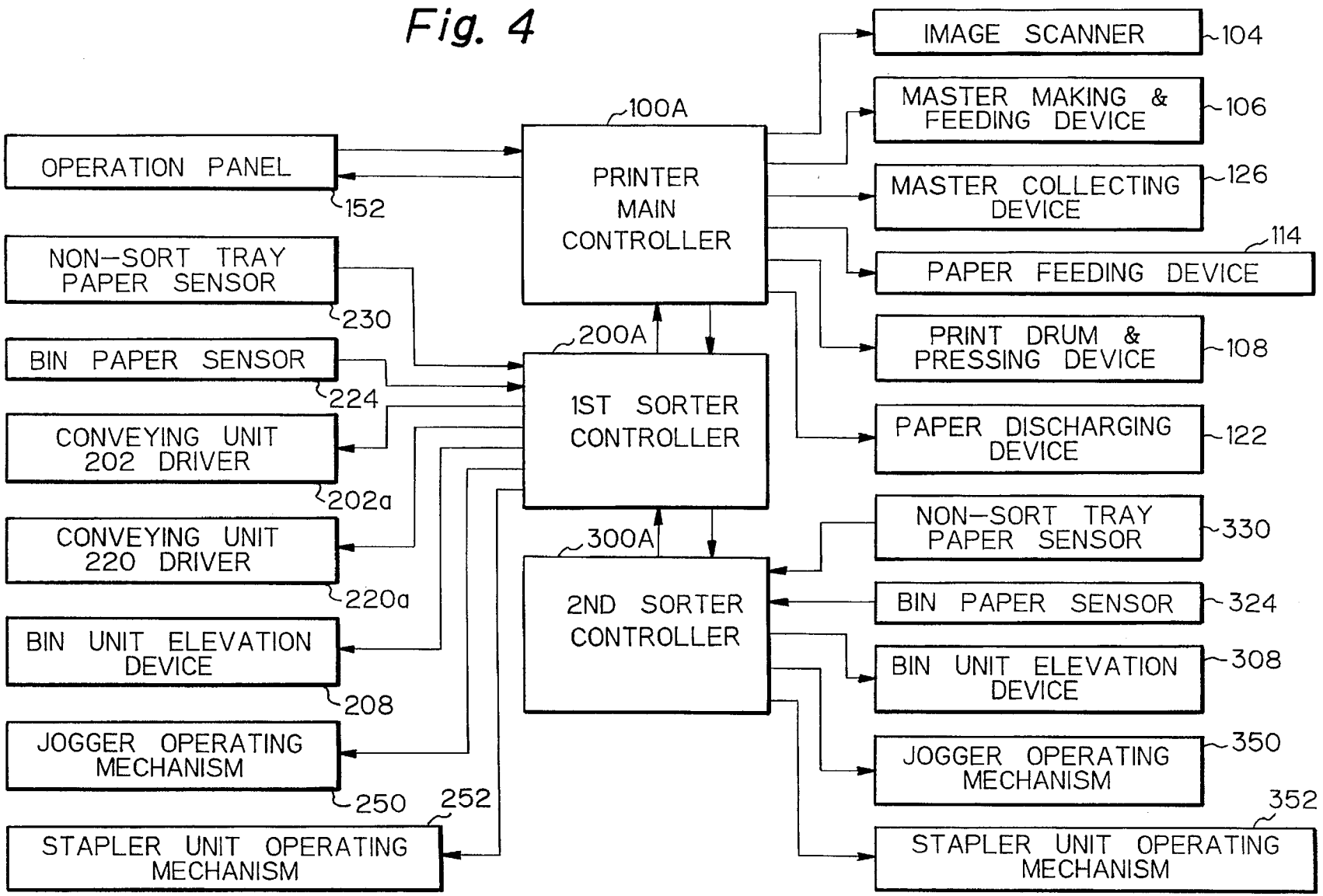
FIG. 4 is a block diagram schematically showing a control device in accordance with the present invention.
Figure 5:
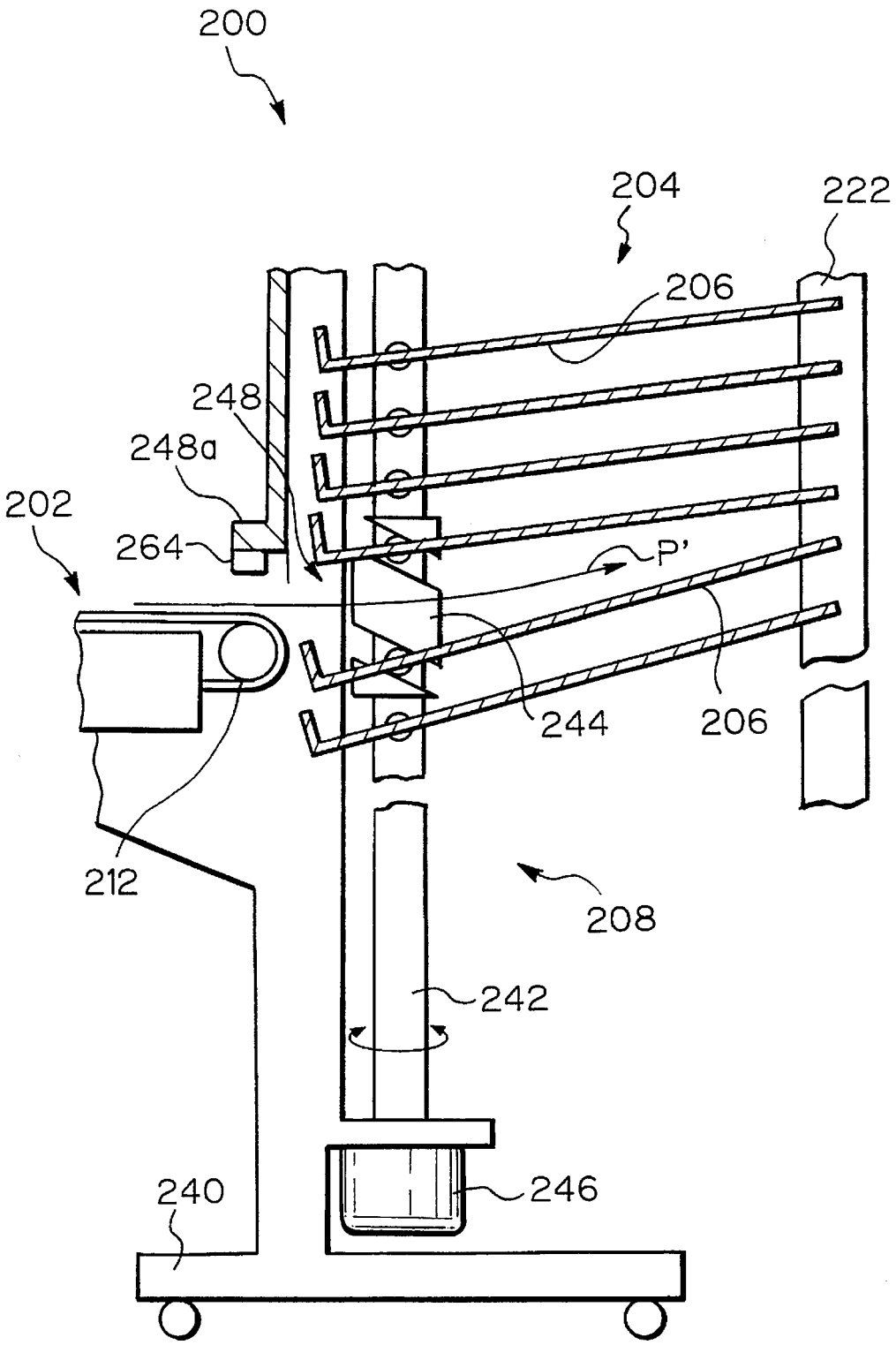
FIG. 5 is a fragmentary vertical section of the sorter shown in FIG. 1.

As shown in FIG. 2, each bin 206 has a substantially flat plate-like configuration. A stop 206*a* rises from one edge of the bin 206 in order to position the trailing edges of the printings P'. The bin 206 is formed with a notch 206*b* for allowing the printings P' to be taken out, a notch 206*c* for preventing the bin 206 from interfering with a staple unit which will be described later, and a notch 206*d* for allowing a jogger 256 to move, as will be described. As shown in FIGS. 1 and 5, the bins 206 are inclined downward to the left. Hence, the printing P' driven into the bin 206 in a direction R, FIG. 2, slightly returns to the left until it has been positioned by the stop 206*a*. Aligned holes 206*e* are formed through the bins 206 in the vicinity of the respective stops 206*a*. A bin paper sensor 224 (shown in FIGS. 1 and 4) determines whether or not printings P' are present on the bins 206. The paper sensor 224 is implemented as a photo-interrupter type optical sensor made up of a light emitting element 224*a* and a light-sensitive element 224*b*. The two elements 224*a* and 224*b* are repsectively mounted on the top and the bottom of the bin unit 204.

Referring again to FI6. 1, the non-sort tray 218 has opposite side fences 226 and an end fence 228 which cooperate to position the printings P' sequentially driven into the tray 218. A non-sort tray paper sensor 230 (shown in FIGS. 1 and 4) is also implemented as a photointerrupter type optical sensor having a light emitting element 230*a* and a light-sensitive element 230*b*. The elements 230*a* and 230*b* are respectively positioned on the top of the bin unit 204 and beneath an aperture formed in the bottom plate of the tray 218.

The joint conveying unit 220 is brought to the position shown in FIG. 1 when the bin unit 204 of the first sorter 200 is raised to the uppermost position. In such a position, the conveying unit 220 tranfers the printings P' sequentially received from the intermediate conveying unit 202 to bins 306 included in the second sorter 300. The conveying unit 220, like the conveying unit 202, has a flat convey belt passed over rollers 232 and 234 and implemented by a plurality of belts 236, and a fan unit 238 located beneath the belt 236 for sucking the printing P'. The flat conveyor belt is formed with a number of apertures, not shown, for sucking the rear of the printing P'. A belt motor, not shown, is drivably connected to the roller 232 to drive the flat conveyor belt. A fan motor, not shown, drives the fan unit 238.

As shown in FIG. 5, the bin unit elevation device 208 has a base 240 on which a pair of spaced shafts 242 are rotatably mounted. A spirial cam 244 is formed with a spiral groove and affixed to substantially the center of each shaft 242. A pully, not shown, is mounted on the bottom of each shaft 242. A timing belt, not shown, is passed over the pulleys of the shafts 242. A motor 246 is connected to one of the two pulleys by a belt, not shown, in order to move the bin unit 204 up and down. When the motor 246 is driven to rotate the spiral cam 244, the bin unit 204 is moved upward or downward. This kind of mechanism is taught in, for example, Japanese Patent Publication No. 3-6104. Specifically, as the motor 246 is rotated in either direction, it causes the spiral cam 244 to rotate with the result that the bin unit 204 is raised or lowered and, at the same time, the bins 206 are sequentially raised or lowered at the paper inlet 248. When the bin unit 204 is held in a lowermost position, the non-sort tray 218 faces the paper inlet 248.

As shown in FIG. 2, the first sorter 200 has a jogger operating mechanism 250 and a stapler unit operating mechanism 252. The mechanism 250 positions the printings P' driven into the bins 206 while the mechanism 252 staples the printings P' stacked on the bins 206. A positioning plate 254 faces the jogger operating mechanism 250 with the intemediary of the bins 206. These mechanisms 252 and 250 and positioning plate 254 are mounted on a body 200*a* of the sorter 200 and do not move integrally with the bin unit 204.

The previously mentioned jogger 256 is implemented as an upright cylindrical rod extending from a member, not shown, included in the bin unit 204. A pulse motor 260, included in the jogger operating mechanism 250, causes t h e jogger 256 to rotate about a fulcrum 258 in a reciprocating motion. The jogger 256 and fulcrum 258 are connected by an arm 262 and rotated by the pulse motor 260. More specifically, as shown in FIG. 2, when the printing P' conveyed by the intermediate conveying unit 202 is driven into the bin 206, the pulse motor 260 is energized at a preselected timing to cause the jogger 256 to rotate counterclockwise about the fulcrum 258. As a result, the jogger 256 presses one side edge of the printing P' until the other side edge abuts against the positioning plate 254. Hence, the printing P is accurately brought to a position P" indicated by a phantom line in FIG. 2. Assume that the sort and staple mode is selected or that the previously ment.ioned manual staple key is pressed. Then, while the bin unit 204 is sequentially moved upward or downward, the stapler unit operating mechanism 252 is moved forward by a drive source, not shown, as indicated by an arrow in FIG. 2. The mechanism 252 causes a staple unit, not shown, to drive a staple into each stack of printings P'.

The mechanisms 250 and 252 are conventional and disclosed in, for example, Japanese Patent Laid-Open Publication No. 2-56367.

As shown in FIG. 5, a paper sensor 264 is mounted on a predetermined portion of a post 248a positioned above a paper inlet 248 and determines whether or not a printing P' has moved away from the inlet 248. The paper sensor 264 is also implemented as a reflection type optical sensor having a light emitting element and a light-sensitive element. An encoder, not shown, is mounted on the end of the shaft 242 in order to detect the angle and speed of rotation of the shaft 242. For the encoder, use may be made of a photo type rotary encoder made up of a slitted disk and a light source and a lightsensitive element positioned at both sides of the disk. The paper sensor 264 and encoder are electrically connected to a control device embodying the present invention and which will be described later specifically. Every time a printing P' moves away from the paper inlet 248, the paper sensor 264 senses it. The control device controllably drives the motor 246 such that the spiral cam 244 makes one turn every time a printing P' moves away from the inlet 248, as determined by the sensor 264. As a result, the bins 206 are raised or lowered by one step at a time. A bin tinit home sensor, not shown, is mounted on a preselected portion of the base 240. The bin unit home sensor determines whether or not the bin unit 204 has been lowered to its home position or initial position. In the home position of the bin unit 204, the top bin 206 faces the paper inlet 248. The bin unit home sensor is also electically connected to the control device.

It is to be noted that in FIG. 5 part of the bins 206, non-sort tray 218 and joint conveying unit 220 are not shown for the sake of clarity.

Referring again to FIG. 1, the second sorter 300 is identical with the first sorter 200 except that it does not have the joint conveying unit on the bottom of a bin unit 304 and does not have the intermediate conveying unit at a paper inlet 348 which leads to the bins 306. A body 300*a* included in the sorter 300 is basically identical with the body 200*a* of the sorter 200. Specifically, a non-sort tray 318 is positioned on the top of the bin unit 304. The jogger operating mechanism 250 and stapler unit operating mechanism 252 are also arranged in the sorter 300. Hence, the constituent parts of the sorter 300 are designated by reference numerals similar to the reference numerals attached to the sorter 200.

If desired, the joint conveying unit shown in FIG. 1 may also be mounted on the bottom of the bin unit 304 of the second sorter 300 in order to connect a third sorter to the sorter 300.

A reference will be made to FIG. 4 for describing the control device embodying the present invention. As shown, the control device includes a main controller 100A built in the printer 100 and controllers 200A and 300A respectively built in the first and second sorters 200 and 300. The controllers 100A, 200A and 300A are electrically connected together in order to interchange various command signals, ON/OFF signals and data signals, while controlling each other. The main controller 100A controls not only the controllers 200A and 300A but also the entire system, i.e., startups, stops and timings of various devices to be described. The controllers 100A, 200A and 300A are each implemented by a microcomputer having a CPU (Central Processing Unit), an I/O (Input/Output) port, ROM (Read Only Memory), RAM (Random Access Memory), etc. The controllers 100A, 200A and 300A are respectively mounted on boards disposed in the printer housing 102, main body 200*a* of the first sorter housing 200, and main body 300*a* of the second sorter housing 300.

The main controller 100A is electrically connected to and interchanges the above-mentioned various signals with the operation panel 152, image scanner 104, master making and feeding device 106, master collecting device 126, paper feeding device 114, print drum and pressing device 108, and paper discharging device 122. The ROM of the main controller 100A stores programs for controlling the startups, stops, timings and so forth of the image scanner 104, master making and feeding device 106, master collecting device 126, paper feeding device 114, print drum and pressing device 108, paper discharging device 122, etc., as well as a program and data relating to sorter selection. The RAM of the main controller 100A is used to store data signals from the keys and ON/OFF signals, as needed.

The main controller, or control means, 100A selects one of the sorters 200 and 300 to use in response to signals from the sorter controllers 200A and 300A, and a signal from the sorter link mode key 166 and representative of the first sorter priority mode, second sorter priority mode, first sorter only mode or second sorter only mode. In addition, the main controller 100A has the following functions (1)–(3).

(1) When one of the sorters 200 and 300 stores the printings P' on the bins thereof while the other is empty, the main controller 100A selects the empty sorter at the beginning of printing in response to the outputs of the paper sensors 224 and 324.

(2) Assume that the sort mode, series mode, group mode or sort and staple mode is selected on the sorter mode key 162, that the number of bins necessary for the mode selected is smaller than the number of bins available with each sorter, and that the number of printings P' to be received in each bin is greater than the maximum number of printings P' which can be stacked in a single bin. Then, the main controller 100A causes printings P' to be distributed to the bins of one sorter up to the maximum number and causes the excess printings P' to be distributed to the bins of the other sorter corresponding in order to those of the above-mentioned bins.

(3) Assume that the non-sort mode is selected on the sorter mode key 162, and that the number of printings P' to be stacked on a single non-sort tray exceeds the capacity of the tray. Then, the maximum allowable number of printings P' are distributed to one non-sort tray determined to be empty by the associated paper sensor 230 or 330. Subsequently, the excess printings P' are delivered to the other non-sort tray also determined to be empty by the associated paper sensor 230 or 330.

The first sorter controller 200A is electrically connected to the paper sensors 230 and 224 as well as to the main controller 100A and second sorter controller 300A. In addition, the sorter controller 200A is electrically connected to a driver 202*a* of the intermediate conveying unit 202, a driver 220*a* of the joint conveying unit 220, bin unit elevation device 208, jogger operating mechanism 250, and stapler unit operating mechanism 252. In response to the ON/OFF signals and data signals from the paper sensors 230 and 224, the sorter controller 200A sends command signals to the mechanisms 202*a*, 220*a*, 208, 250 and 252.

The second sorter controller 300A is electrically connected to the paper sensors 330 and 324 as well as to the first sorter controller 200A. In response to the ON/OFF signals and data signals from the paper sensors 330 and 324, the sorter controller 300A sends command signals to the bin unit elevation device 308, jogger operating mechanism 350, and stapler unit operating mechanism 352.

As stated above, the first and second sorter controllers 200A and 300A respectively control the entire system of the first sorter 200, including startups and stops, and the entire system of the second sorter 300.

Referring to FIGS. 1–5, embodiments of the present invention practicable with the stencil printer 100 and first and second sorters 200 and 300 will be described hereinafter.

1st Embodiment

Assume that twenty copies of three printings respectively corresponding to three documents A, B and C should be prepared and stapled. First, the operator sequentially stacks the documents C, B and A in this order on the table 132 of the printer 100. Then, the operator enters the desired number of copies "20" on the numeral keys 154 of the operation panel 152. Subsequently, the operator presses the sorter mode key 162 three times roes to select the sort and stable mode. As a result, the LED 164*c* on the panel 152 turns on to show the operator that the desired mode has been set up. Thereafter, the operator presses the sorter link mode key 166 twice to select the second sorter priority mode. In response, the LED 168*b* turns on to indicate the mode selected.

The operator, selected the various modes stated above, presses the master start key 158. Then, the master collecting device 126 is driven to cause the roller pair 150 thereof to remove the used master S from the print drum 110. The waste master S is collected in the box 128 by the roller pair 150. Subsequently, the print drum 110 is rotated to the stand-by position shown in FIG. 1. This is the end of a master collecting step. In parallel with this step, a master making step is executed, as follows. The first document C is fed from the table 132 to the image scanner 104 by the ADF. The image scanner 104 reads the document C and generates a corresponding image signal. In the master making and feeding device 106, the thermal head 134 selectively generates heat in accordance with the image signal, thereby perforating the stencil S paid out from the roll. The perforated stencil S is conveyed to the clamper 140, which is open, by rollers. The stencil S is wrapped around the print drum 110 by having the leading edge thereof retained by the clamper 140. When a stepping motor, not shown, driving the platen roller 136 rotates a predetermined number of steps, it is determined that the stencil S has been conveyed by a predetermined amount. Then, the stepping motor and, therefore, platen roller 136 is caused to stop rotating. In this condition, the trailing edge of the perforated part of the stencil S is cut by the cutter 138. Consequently, the cut length of the stencil, or master, S is fully wrapped around the print drum 110.

The master making step stated above is followed by a printing step. First, the uppermost paper P on the tray 116 is picked up by the pick-up rollers 118 and fed toward the feed rollers 120. The feed rollers 120 drive the paper P into the gap between the print drum 110 and the press roller 112 at a predetermined timing synchronous to the rotation of the drum 110. Then, the press roller 112 is raised to press the paper P against the master S wrapped around the drum 110 which is rotating counterclockwise. As a result, ink is transferred to the paper P via pores of the print drum 110 and perforations of the master S, thereby reproducing the document C on the paper P. Subsequently, the paper, or printing, P' is separated from the print drum 110 by the separator, not shown, and conveyed to the intermediate conveying unit 202 by the paper discharging device 122. At the same time, the belt motor and fan motor of the intermediate conveying unit 202 and those of the joint conveying unit 220 start operating.

In the second sorter only mode selected, the first sorter controller 200A causes the sorter 200 to raise the bin unit from the home position to the uppermost position shown in FIG. 1 while the master making procedure is under way. 0n the other hand, the second sorter controller 300A causes the sorter 300 to hold the bin unit 304 in a lowermost position where the non-sort tray 318 faces the paper inlet 348.

The first printing (usually one) P' derived from the new master S is a trial printing and driven out to the non-sort tray 318 of the second sorter 300 to allow the operator to check it. Specifically, the trial printing P' is simply discharged to the non-sort tray 318 via the joint conveying unit 220 without being counted.

On determining that the trial printing P' is acceptable, the operator presses the print start key 160. Then, the document C is reproduced on twenty consecutive papers P while the bin unit 304 of the second sorter 300 is sequentially raised. As a result, twenty printings P' are sequentially distributed to the top bin 306 to the bottom bin 306 one by one. At this instant, the first sorter 200 is held in the uppermost position shown in FIG. 1. Every time a single printing P' is received in one of the bins 306, a pulse motor 360 of a jogger operating mechanism 350 corresponding to the pulse motor 260 of the jogger operating mechanism 250 is driven to move a jogger 356 corresponding to the jogger 256 back and forth so as to position the printing P' on the bin 306.

After twenty printings P' associated with the first document C have been produced, the previously mentioned document sensor determines whether or not the second document B is present on the table 132. If the document B is present, the master S produced from the first document C is automatically removed from the print drum 110 and collected in the box 128 in the manner stated earlier. In parallel with master collecting procedure, the second document B is fed by the ADF and read by the image scanner 104. Again, the master making and feeding device 106 perforates the stencil S and wraps it around the print drum 110. At this time, the bin unit 304 of the second sorter 300 is lowered to the home position. If the first or trial printing P' derived from the document B and driven out to the non-sort tray 318 is acceptable, the print start key 160 is pressed. Then, the document B is reproduced on twenty consecutive papers P while the bin unit 304 is sequentially elevated. Consequently, twenty printings P' are sequentially distributed to the top bin 306 to the bottom bin 306 one by one.

The master collecting, document reading, master making and feeding and trial printing steps are repeated with the third document A to reproduce it on twenty consecutive papers P. As a result, three printings P' are received in each of the twenty bins 306 of the second sorter 300. Thereafter, the stacks of printings P' positioned by the jogger 356 are sequentially stapled, as follows. First, the stapler unit operating mechanism 352 moves forward to drive the staple unit thereof into the three printings P' received in the lowermost bin 306 and then retracts. Subsequently, the bin unit 304 is lowered by one step. The mechanism 352 again moves forward to staple the three printings P' received in the bin 306 overlying the bottom bin and then retracts. Such a stapling action is repeated twenty times.

To save time, the illustrative embodiment allows the next master making and printing operation to be executed with the first sorter 200, which is idle, while the stapling operation is under way. Specifically, after all the printings P' associated with the documents A–C have been produced, the operator lays another document D on the table 132 and presses the sorter mode key 162 four times to select the group mode. As a result, the LED 164d assigned to the group mode turns on. The main controller 100A determines, in response to a signal from the paper sensor 324, that the printings P' are present on the bins 306 of the second sorter 300 and determines, in response to a signal from the second sorter controller 300A, that the sorter 300 is stapling the printings P'. The main controller 100A, therefore, sees the sorter available, automatically changes the sorter link mode to the first sorter only mode, and then turns on the LED 168*c* assigned to such a mode. In this condition, only the first sorter 200 is usable.

Specifically, assume that printings derived from a single document D should be divided into ten groups each having twenty printings. Then, the operator enters 20 (papers)×10 (groups) on the numberal keys 154. If the operator enters, for example, 20 (papers)×30 (groups), the main controller 100A sends an alarm signal to the operation panel 152 since only the twenty bins of the first sorter 200 are available in the first sorter only mode. In response, the LCD of the operation panel 152 displays a message showing the operator that more than twenty groups are not available. When the operator, entered 20 (papers)×10 (groups), presses the master start key 158, the used master collecting step to the master feeding step are executed. At the same time, the bin unit 204 of the first sorter 200 is lowered to the lowermost position. The first or trial printing derived from the document D is driven out to the non-sort tray 218 of the first sorter 200. Subsequently, when the operator presses the print start key 160, the bin unit 204 is held in the home position. Ten printings are sequentially produced while the bin unit 204 is sequentially elevated. As a result, the ten printings are distributed to the upper ten bins 206, respectively. Then, the printing operation is interrupted to allow the bin unit 204 to be again lowered to the home position where the top bin 206 is ready to receive a printing. In this condition, the printing operation is resumed to produce ten consecutive printings. While the bin unit 204 is sequentially raised, such ten printings are respectively distributed to the upper ten bins 206 in the same manner as the previous ten printings. Such a procedure is repeated twenty times to stack twenty printings on each of the upper ten bins 206.

The stapling operation of the second sorter 300 ends while the above-stated master making, printing and sorting operation is performed with the first sorter 200. Then, either the printer 100 or the second sorter 300 informs the operator of the end of stapling. This allows the operator to take out the stapled printings P' from the bins 306 of the second sorter 300 without haste. Further, assume that while a first person is using the second sorter 300 in the sort mode, a second person desires to produce urgent printings in, for example, the group mode. In such a case, the second person can obtain desired printings by using the first sorter 200.

The control over the two sorters 200 and 300 in the group mode described above is extremely effective when they are connected to the stencil printer 100. It has been customary with a group mode to continuously discharge twenty printings to one bin, raise a bin unit one step, and then continuously discharge another twenty printings to the next bin. This, however, brings about a problem that the printings are apt to suffer from smears on their rear and leading edges and to jam transport paths, as discussed earlier. Distributing printings to the ten bins 206 of the first sorter 200 one by one and repeating it twenty times, as in the embodiment, obviates the above problem and thereby increases the number of printings which can be received in a single bin. This kind of control in the group mode may be applied to fine papers and PPC papers which are extremely susceptible to smears on the rear.

2nd Embodiment

Assume that a school, for example, has twelve classes each accommodating fourty students, and that twelve groups of fourty printings should be produced with a single document E in the group mode. However, each bin of the two sorters 200 and 300 cannot accommodate more than thirty printings. The embodiment to be described solves this problem, making the most of the linked sorters and considering the easy take-out of printings. First, the operator lays the document E on the table 132 and presses the sorter mode key 162 four times to select the group mode. Then, the LED 164d assigned to the group mode turns on. Subsequently, the operator presses the sorter link mode key 166 twice to select the second sorter priority mode. In response, the LED 168*b* assigned to the second sorter priority mode turns on. It is to be noted that the second sorter priority mode is selected in order to facilitate the take-out of printings. In the second sorter priority mode, the second sorter 300 is operated prior to the first sorter 200; printings which cannot be accommodated in bins 306 of the second sorter 300 are distributed to the bins 206 of the first sorter 200.

The operator enters 40 (papers)×12 (groups) on the numeral keys 154 and then presses the master start key 158. This is followed by the previously stated procedure for collecting the used master, reading the document E, making a master, and wrapping it around the print drum 110. During this period of time, the bin unit 204 of the first sorter 200 is raised to the uppermost position, so that the joint conveying unit 220 faces the intermediate conveying unit 202. In the second sorter priority mode, the bin unit 304 of the second sorter 300 is held in the lowermost position, as stated in relation to the first embodiment. A trial printing associated with the document E is driven out to the non-sort tray 318 of the second sorter 300. When the operator pesses the print start key 160, the bin unit 304 is held in the home position. Twelve printings are continuously produced while the bin unit 304 is sequentially raised. As a result, the twelve printings are distributed to the upper twelve bins 304 one by one. Subsequently, the printing operation is interrupted to allow the bin unit 304 to be lowered to the home position where the top bin 306 is ready to receive a printing. Then, the printing operation is resumed to produce another twelve printings. These twelve printings are respectively distributed to the upper twelve bins 306 being sequentially raised. Such a procedure is repeated thereafter.

After the above procedure has been repeated thirty times, the second sorter controller 300A sends a signal indicating the full state of the bin unit 304 to the main controller 100A via the first sorter controller 200A. In response, the main controller 100A interrupts the printing operation and sends to the first sorter controller 200A a signal commanding it to prepare the first sorter 200 for reception. At this stage, the upper twelve bins 306 of the second sorter 300 have been loaded with thirty printings each. In response to the command, the first sorter controller 200A lowers the bin unit 204 to the home position where the top bin 206 faces the paper inlet 248. Then, the printing operation is resumed to produce another twelve printings. These printings are respectively distributed to the upper twelve bins 206 of the bin unit 204 being sequentially elevated. When such a procedure is repeated ten times, all the 40×12 printings are produced and stacked on the sorters 200 and 300. Specifically, ten printings are stacked on each of the upper twelve bins 206 of the first sorter 200. Then, the printer 100 stops operating.

The operator takes out the ten printings from the top bin 206 of the first sorter 200, takes out the thirty printings from the top bin 306 of the second sorter 300, and combines them to prepare a group of fourty printings. In the same manner, the operator takes out the stacks of printings from the other bins 206 and 306 and combines them. As a result, twelve groups of fourty printings are obtained which are free from smears on the rear and leading edges.

With the control over the sorters 200 and 300 in the sort mode described above, it is possible to produce, for example, even eighteen copies of fourty-page printings. In such a case, the operator stacks fourty documents on the table 132, enters "18 (papers)" on the numeral keys 154, and the presses the master start key 158 and print start key 160. As a result, the first to thirtieth pages are received in each of the upper eighteen bins 306 of the second sorter 300, and the thirty-first to fourteeth pages are received in each of the upper eighteen bins 206 of the first sorter 200.

3rd Embodiment

Assume that 1,000 urgent printings, for example, should be produced in the non-sort mode, but the maximum number of printings which can be accommondated in each of the non-sort trays 218 and 318 of the sorters 200 and 300 is 350.

Although producing 1,000 printings continuously is desirable, such a number of printings exceeds the total capacity of the non-sort trays 218 and 318. Even when three sorters are connected to a printer, each sorter has only one non-sort tray, as shown in, for example, FIG. 3 of previously mentioned Japanese Patent Laid-Open Publication No. 60-248566. Hence, a great number of printings are not attainable unless they are repeatedly taken out from the non-sort trays several times in a stack of 350 printings during the course of printing. This is extremely troublesome and, in addition, forces the operator to stand by the printer until the printing operation ends. This embodiment obviates this drawback by executing the following control.

The operator sets a single document F on the document table 132 and presses the sorter mode key 162 once to select the non-sort mode (this mode will be automatically set up when the power switch of the printer 100 is turned on). In response, the LED 164*a* assigned to the non-sort mode turns on. At this instant, the operator sees if the LED 168*a* associated with the sorter link mode key 166 and assigned to the first sorter priority mode is glowing. In this condition, the operator enters "1,000 (papers)" on the numeral keys 154 and presses the master start key 158. In response, the collection of the waste master to the wrapping of a new master on the print drum 110 occurs. In this case, both the bin units 204 and 304 of the sorters 200 and 300 are held in their lowermost positions. After a trial printing associated with the document F has been driven out to the non-sort tray 218 of the first sorter 200, the operator presses the print start key 160. As a result, 350 printings are continuously produced and sequentially stacked on the non-sort tray 218 of the first sorter 200. Then, the printing operation is interrupted. If the non-sort tray 318 of the second sorter 300 is empty as determined by the paper sensor 330, the output of the sensor 330 is sent to the main controller 100A via the second and first sorter controllers 300A and 200A. In response, the main controller 100A determines that the nonsort tray 318 is idle, and prepares the tray 318 for reception. Specifically, the bin unit 204 of the first sorter 200 is raised to the uppermost position while the joint conveying unit 220 is prepared for operation. Subsequently, the printing operation is resumed to produce another 350 printings. These printings are sequentially stacked on the non-sort tray 318 of the second sorter 300.

The operator, therefore, should only take out the 350 printings from the non-sort tray 218 of the first sorter 200 without haste. When 350 printings are fully stacked on the non-sort tray 318 of the second sorter 300, the printing operation is again interrupted. At this time, if the non-sort tray 218 is empty as determined by the paper sensor 230, the main controller 100A sees that the tray 218 is idle in response to the output of the sensor 230. Then, the main controller 100A prepares the non-sort tray 218 for reception, i.e., lowers bin unit 204 of the sorter 200 to the lowermost position. In this condition, another 300 printings are produced and stacked on the non-sort tray 218. If printings exist on the non-sort tray 218, as determined by the paper sensor 230, the main controller 100A prevents the printer 100 from resuming the operation and sends an alarm signal to the LCD of the operation panel 152. In response, the LCD displays an adequate alarm message, e.g., "Please remove printings from non-sort tray".

When three sorters are connected to the printer 100 and only two of them have a non-sort tray, the two non-sort trays will be effectively used in the same way as the non-sort trays 218 and 318.

In summary, it will be seen that the present invention has various unprecedented advantages as enumerated below.

(1) When two or more sorters are linked to an image forming apparatus, a person can freely select one or more of the sorters matching the user's intention and needs. The total printing time is decreased.

(2) By using the last sorter first, it is possible to facilitate the take-out of printings and to protect them from smears on the rear and leading edges.

(3) An empty sorter is automatically selected. The user or operator, therefore, does not have to search for an idle sorter each time.

(4) Assume that two sorters are connected to the image forming apparatus, and that the capacity available with a single bin is not great enough to accommodate a desired number of printings. Then, after printings have been produced and received in, for example, the bins of the second sorter in the second sorter priority mode and in the sort mode or group mode, the second sorter priority mode is immediately replaced with the first sorter priority mode or the first sorter only mode. Hence, the following printings can be produced by use of the first sorter without interruption, i.e., without requiring the operator to remove the printings from the second sorter.

(5) When a number of printings are desired in a non-sort mode, it is not necessary for the operator to repeatedly take out a stack corresponding to the capacity of a non-sort tray several times during the course of printing. The operator, therefore, does not have to stand by the apparatus throughout the operation and can use the image forming (printing) time efficiently.

Various modifications will become possible for those skilled in the art after receiving the teachings of the present disclosure without departing from the scope thereof. For example, while the embodiments have concentrated on two sorters, three or more sorters may be connected to the printer. The stencil printer may, of course, be replaced with any other kind of printer, e.g., intaglio printer, or an electrophotographic copier, printer or facsimile apparatus. The sorter link mode key has been assumed to implement all of a first sorter priority mode, second sorter priority mode, first sorter only mode, and second sorter only mode. Alternatively, the sorter link mode key may implement, for example, only the second sorter priority mode and first sorter only mode or one to three different modes by combining them.

While the sorter mode key, sorter link mode key, LEDs and so forth are arranged on the operation panel of the stencil printer in the embodiments, they may be provided on the operation panel of the first sorter or that of the second sorter. The first sorter controller and second sorter controller may be built in the printer together with the main controller, if desired. Further, the control functions of the main controller may be assinged to the first sorter controller and/or the second sorter controller. In the third embodiment, sorter link mode key implementing the priority modes and exclusive modes may be omitted, if desired.

What is claimed is:

1. A control device for controlling an image forming apparatus having a plurality of interconnected sorters each having a plurality of bins for sorting papers undergone image formation, said control device comprising:

at least one of priority mode setting means for setting a priority mode for causing any one of a first sorter to a last sorter to operate prior to the other sorter, and exclusive mode setting means for causing only one of any of said first sorter to said last sorter to operate; and control means for selecting the sorter to be used in response to an output signal of said priority mode setting means or an output signal of said exclusive mode setting means.

2. A control device as claimed in claim 1, further comprising bin paper sensing means for determining whether or not the papers are present on the bins of the sorters, wherein when one of said sorters is a full sorter whose bins are loaded with the papers and the other sorter is an empty sorter whose bins are not loaded with the papers, said control means selects, at the beginning of an image forming operation, said empty sorter in response to the output signal of said bin paper sensing means.

3. A control device as claimed in claim 1, further comprising at least one of:

sort mode setting means for setting up a sort mode for sorting the papers matching a plurality of pages of documents in each of the bins in order of page;

series mode setting means for setting up a series mode for serially distributing the papers derived from a single document to the bins one by one;

group mode setting means for setting up a group mode for distributing the papers derived from a single document to the bins in groups each having a predetermined number of papers; and sort and staple mode setting means for setting up a sort and staple mode for executing stapling automatically after a sorting operation.

4. A control device as claimed in claim 3, wherein assuming that one of said sort mode, said series mode, said group mode and said sort and staple mode is selected, that a number of bins necessary for the mode selected is smaller than a number of bins available in each of the sorters, and that a number of papers to be received in one bin is greater than a maximum number avalable with the bin, the papers matching said maximum number are distributed to the bins of one of said sorters while the other papers exceeding said maximum number are distributed to the bins of the other sorter corresponding in order to said bins of said one sorter.

5. A control device for controlling an image forming apparatus having a plurality of interconnected sorters each having a plurality of bins for sorting papers undergone image formation and a non-sort tray, said control device comprising:

non-sort mode setting means for setting up a non-sort mode for stacking the papers derived from a single document on the non-sort tray;

non-sort tray paper sensing means for determining whether or not the papers are present on the non-sort tray; and control means for executing, when said non-sort mode is selected and a number of papers to be received in a single non-sort tray is greater than a maximum number available with the non-sort tray, control such that the papers matching said maximum number are stacked on a first non-sort tray of a first sorter where the papers are absent while the other papers exceeding said maximum number are stacked on a second non-sort tray of a second sorter where the papers are absent until said maximum number of papers are stacked on the second non-sort tray, and the papers are again stacked on the first non-sort tray of the first sorter if papers are again absent therefrom.

* * * * *